US005682981A

United States Patent [19]

Sudborough

[11] Patent Number: 5,682,981

[45] Date of Patent: Nov. 4, 1997

[54] ARTICLE HOLDING DEVICE

[76] Inventor: Richard Rainer Sudborough, 8548 Minuet Pl., Panorama City, Calif. 91402

[21] Appl. No.: 572,033

[22] Filed: Dec. 14, 1995

[51] Int. Cl.[6] ..... B65D 85/00; F23Q 2/16

[52] U.S. Cl. ..... 206/38.1; 206/349; 206/371; 431/253

[58] Field of Search ..... 206/37, 37.1, 37.8, 206/38, 38.1, 39, 85, 86, 214, 349, 371; 150/154, 161, 165; 431/129, 144, 152, 253

[56] References Cited

U.S. PATENT DOCUMENTS

| | | | |
|---|---|---|---|
| 3,613,416 | 10/1971 | Paton | 206/37.1 |
| 4,486,169 | 12/1984 | Lewis | 431/253 |
| 4,745,661 | 5/1988 | Wainscott | 431/253 |
| 4,854,856 | 8/1989 | Steiger, Jr. et al. | 431/253 |
| 4,863,013 | 9/1989 | Eastman | 206/5 |
| 4,907,694 | 3/1990 | Miller et al. | 206/38.1 |
| 5,169,305 | 12/1992 | Kee | 431/253 |

*Primary Examiner*—Jimmy G. Foster

*Attorney, Agent, or Firm*—Michael I. Kroll

[57] ABSTRACT

An article holding device (10) comprising an article (12) having an elongated portion (14). A structure (16) is for covering the elongated portion (14) of the article (12), to help prevent loss of the article (12).

1 Claim, 2 Drawing Sheets

ARTICLE HOLDING DEVICE

BACKGROUND OF THE INVENTION

1. Field of the Invention

The instant invention relates generally to cigarette lighter securing accessories and more specifically it relates to an article holding device.

2. Description of the Prior Art

Numerous cigarette lighter securing accessories have been provided in prior art. For example, U.S. Pat. No. 4,486,169 to Lewis; U.S. Pat. No. 4,898,532 to Bercik; U.S. Pat. No. 4,927,354 to Sanford; U.S. Pat. No. 5,026,274 to Jacob; U.S. Pat. No. 5,067,895 to Chuang et al.; U.S. Pat. No. 5,181,847 to DaSilva and U.S. Pat. No. 5,271,730 to Acacio da Silva all are illustrative of such prior art. While these units may be suitable for the particular purpose to which they address, they would not be as suitable for the purposes of the present invention as heretofore described.

LEWIS, MARCUS E.

CIGARETTE LIGHTER SECURING ACCESSORY

U.S. Pat. No. 4,486,169

A cigarette lighter securing accessory includes a lighter holder connected to a lighter by extensible cord means, means for retracting the cord means from an extended position, and, preferably, means on the holder for attaching it to a support. A preferred additional element, for use with a replaceable and/or disposable lighter, is a lighter receptacle, which is removably connected to the lighter and is connected to the cord, between them.

BERCIK, DAVID P.

RETRACTABLE LIGHTER APPARATUS

U.S. Pat. No. 4,898,532

A retractable lighter apparatus discloses a retractable housing member including a spring-biased retractable first length of chain positionable within a housing secured to a second length of chain with an intermediate abutment sphere to maintain the second length of chain exteriorly of the housing. The second length of chain is integrally secured to a "C" shaped spring clip at its remote end securable about a cigarette lighter. The cigarette lighter and clip are positionable within a pouch of an internal diameter complementary to that of the external diameter of the "C" shaped clip, wherein the "C" shaped clip and associated second length of chain are directed within the pouch and along a slot axially positioned through a wall of the pouch. The retraction member and the pouch are each provided with clips for securement to various garment portions of an individual.

SANFORD, KIRK

RETRACTABLE CIGARETTE LIGHTER HOLDER

U.S. Pat. No. 4,927,354

A device comprising in combination a cigarette lighter and a housing with a retractable reel mechanism contained therein. The housing is formed of two generally cup-shaped halves secured together and houses a coil spring and retractable take-up spool therein for connection to one end of a cord or the like. The other end is coupled to a fastener configured and adapted for captively and releasably retaining the cigarette lighter. Cord retraining means is included for retaining the amount of extension of the cord at a selected point, the release of which allows the reel mechanism to retract the lighter. A clip member or the like is attached to a side surface of the housing for enabling attachment of the device to an article of wearing apparel, such as a belt or waistband of trousers. In one embodiment, the circumference of the housing is cut away or contoured to form a lighter receiving cavity or compartment configured and adapted for releasably retaining the cigarette lighter.

JACOB, HANNES

HOLDING DEVICE FOR A LIGHTER

U.S. Pat. No. 5,026,274

The holding device consists of a housing having a means of attachment and suspension. The housing contains an extension device formed by a reel and return spring for a tension cord attached to the reel. The cord passes through an opening in the housing and is used for attaching the lighter. A catch shaft for the lighter surrounds the opening in the housing.

CHUANG, JACK LIN, TSUNG-PING

LIGHTER-ACTUATED BINGO MEANS

U.S. Pat. No. 5,067,895

A bingo device includes a gas lighter embedded in a holder casing having a lotto flash driver and a buzzer formed in the casing. Upon an ignition of the lighter by depressing a gas lever of the lighter, the lotto flash driver will be actuated for flashing plural lamps and also for sounding a buzzer for lighting, entertaining and playing purposes.

DaSILVA, EDILBERTO A.

LIGHTER-KEY-HOLDER ARRANGEMENT

U.S. Pat. No. 5,181,847

An improved lighter-key-holder arrangement, wherein the key-holder is independent from the lighter and comprises a detachable fitting having a cross-section similar to that of the lighter. The cross-section can be circular or rectangular. The fitting is coupled to the lighter by a threaded pin centrally formed thereon and received in a threaded bore hole centrally formed on the bottom surface of the lighter. The fitting is provided with a transverse opening that is closed by a latch actuated by a spring and manually operated by an external button. In another embodiment, the fitting has a cross-section different from that of the lighter. In yet another embodiment, the lighter body is spherical.

ACACIO dA SILVA, EDILBERTO

LIGHTER-KEY-HOLDER COMBINATION

U.S. Pat. No. 5,271,730

An improved lighter-key-holder arrangement, wherein the key-holder is independent from the lighter and comprises a detachable fitting having a cross-section similar to that of the lighter. The cross-section can be circular or rectangular. The fitting is coupled to the lighter by a threaded pin centrally formed thereon and received in a threaded bore hole centrally formed on the bottom surface of the lighter. The fitting is provided with a transverse opening that is closed by a latch actuated by a spring and manually operated by an external button. In another embodiment, the fitting has a cross-section different from that of the lighter. In yet another embodiment, the lighter body is spherical. In still another embodiment, a connecting ring may be provided on the body of the lighter, on the fitting or on the trigger lever of the lighter.

SUMMARY OF THE INVENTION

A primary object of the present invention is to provide an article holding device that will overcome the shortcomings of the prior art devices.

Another object is to provide an article holding device that consists of a flexible sheath which can fit over various articles, such as a cigarette lighter, a pen and a hammer, so as to prevent the loss of the various articles.

An additional object is to provide an article holding device whereby when the flexible sheath is fitted to the cigarette lighter, a ring connected to the sheath will hold keys, when the flexible sheath is fitting to the pen, a ring connected to the sheath will hold a fixed lanyard thereto and when the flexible sheath is fitted to the hammer, a loop connected to the sheath will suspend the hammer from a ring on a mounting plate on a wall.

A further object is to provide an article holding device that is simple and easy to use.

A still further object is to provide an article holding device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
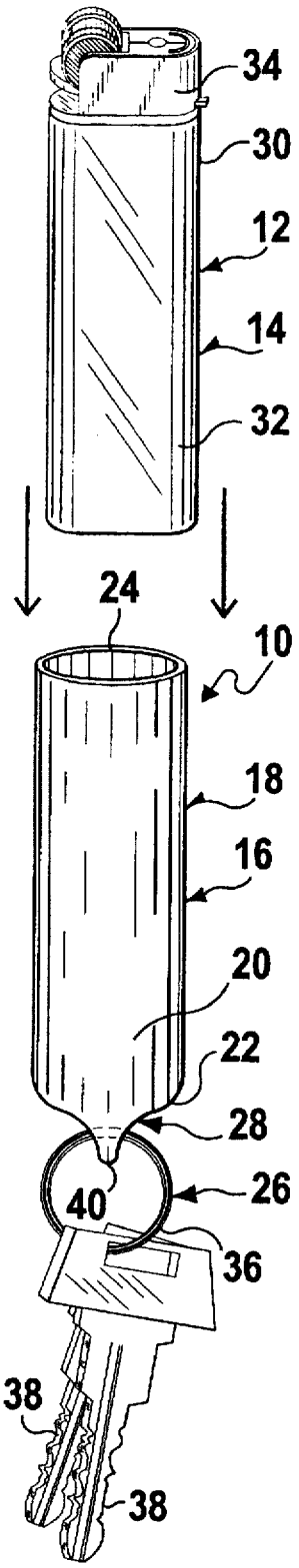
FIG. 1 is a perspective view of a first embodiment of the instant invention ready to engage with a cigarette lighter.

Turning now descriptively to the drawings, in which similar reference characters denote similar elements throughout the several views, FIGS. 1 through 6 illustrate an article holding device 10, comprising an article 12 having an elongated portion 14. A structure 16 is for covering the elongated portion 14 of the article 12, to help prevent loss of the article 12.

The covering structure 16 is a flexible form fitting sheath 18, that can roll back and then roll over the elongated portion 14 of the article 12. The covering structure 16 includes a housing 20 having a closed end 22 and an open end 24, to receive the elongated portion 14 of the article 12.

A continuous curved piece 26 is provided. A facility 28 is for retaining the continuous curved piece 26 to the closed end 22 of the covering structure 16.

Figure 4:
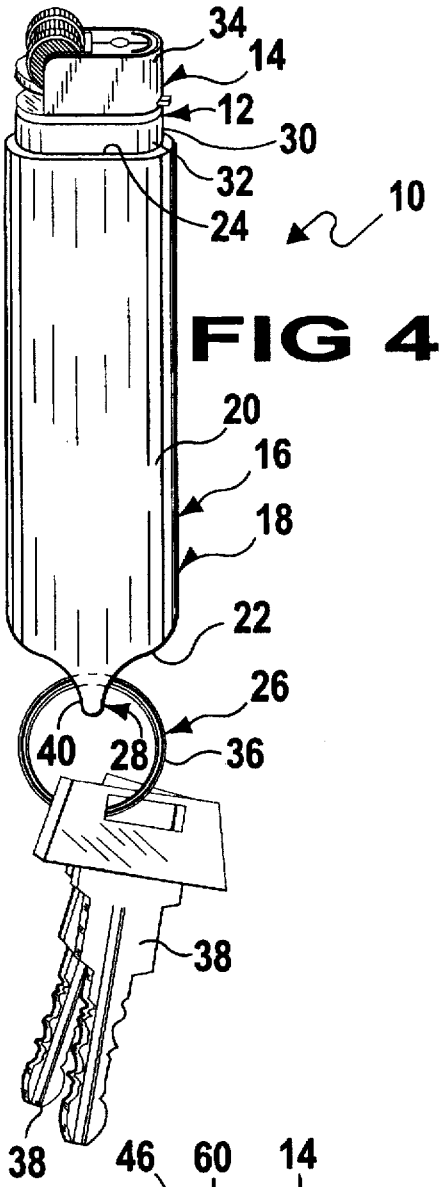
FIG. 4 is a perspective view of the first embodiment engaged with the cigarette lighter.

The article 12, as shown in FIGS. 1 and 4, is a cigarette lighter 30 having a body 32 and a top sparking mechanism with flam source 34. The covering structure 16 engages the body 32 of the cigarette lighter 30. The continuous curved piece 26 is a key ring 36, to hold keys 38 thereon.

The retaining facility 28 is a lug 40 integral with an projecting from the closed end 22 of the covering structure 16. The lug 40 will retain the key ring 36 thereto.

Figure 2:
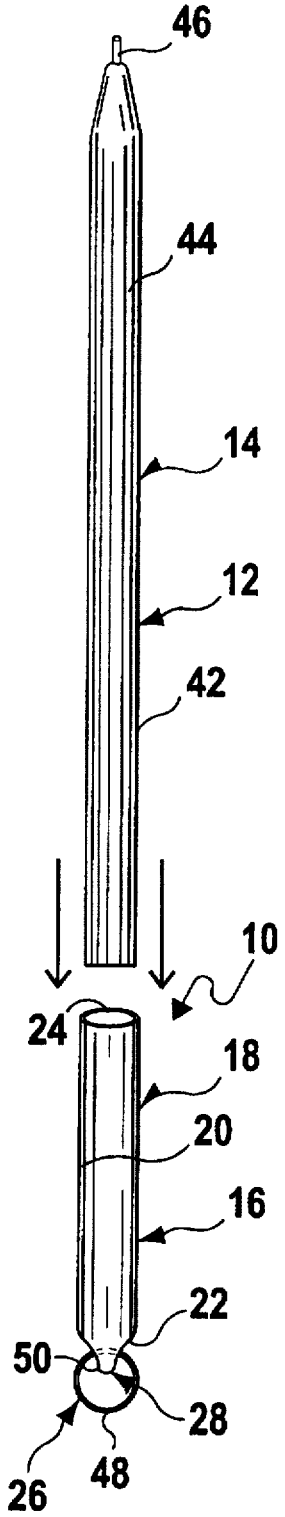
FIG. 2 is a perspective view of a second embodiment of the instant invention ready to engage with a pen.
Figure 6:
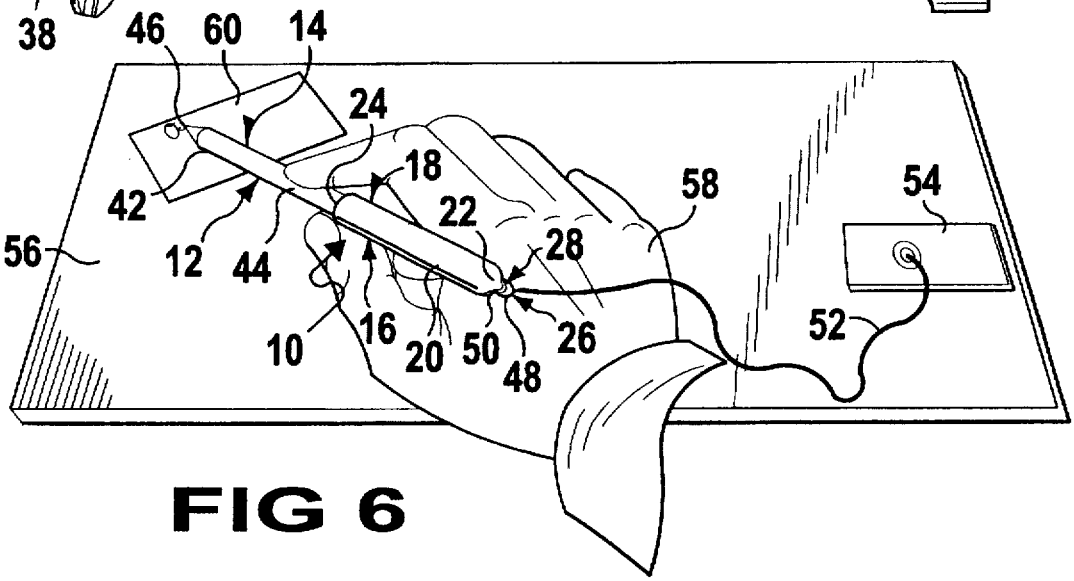
FIG. 6 is a perspective view of the second embodiment engaged with the pen and connected to a fixed lanyard, in which the pen is being used.

The article 12, as shown in FIGS. 2 and 6, is a pen 42 having a barrel 44 and a writing tip 46. The covering structure 16 engages the barrel 44 of the pen 42. The continuous curved piece 26 is a ring 48.

The retaining facility 28 is a lug 50 integral with and projecting from the closed end 22 of the covering structure 16. The lug 50 will retain the ring 48 thereto.

In FIG. 6, a lanyard 52 is shown connected at a first end to the ring 48. A mounting plate 54 has a second end of the lanyard 52 connected thereto. The mounting plate 54 can be affixed such as by adhesive to a writing surface 56, thereby enabling a person to grasp the barrel 44 of the pen 42 by the hand 58 and write with the writing tip 46 on a piece of paper 60 placed onto the writing surface 56.

Figure 3:
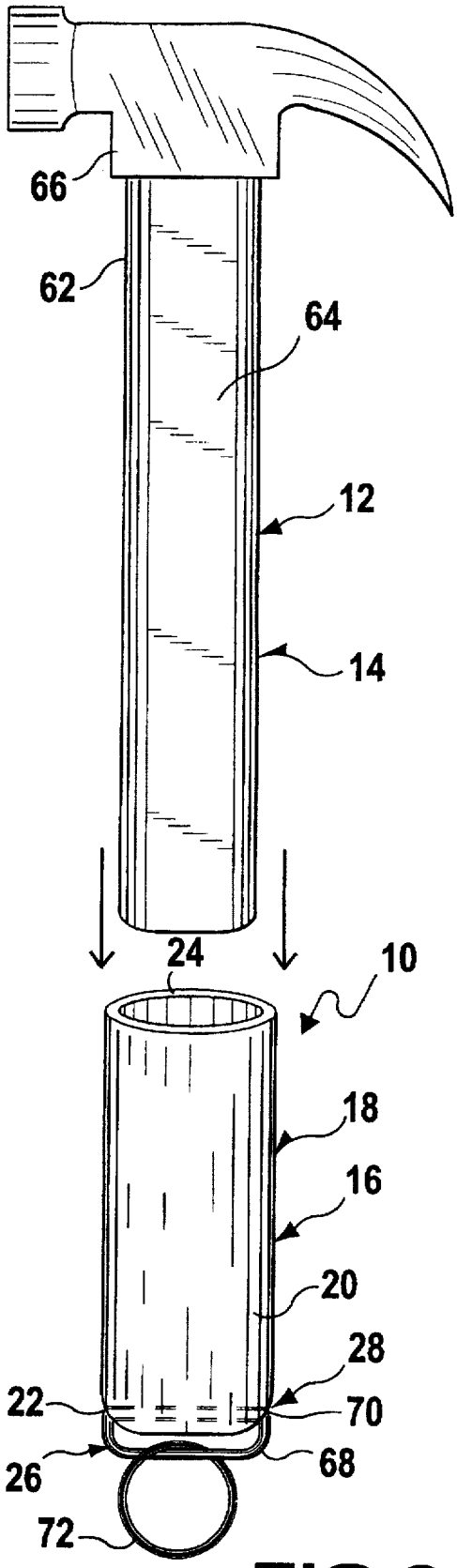
FIG. 3 is a perspective view of a third embodiment of the instant invention ready to engage with a hammer.
Figure 5:
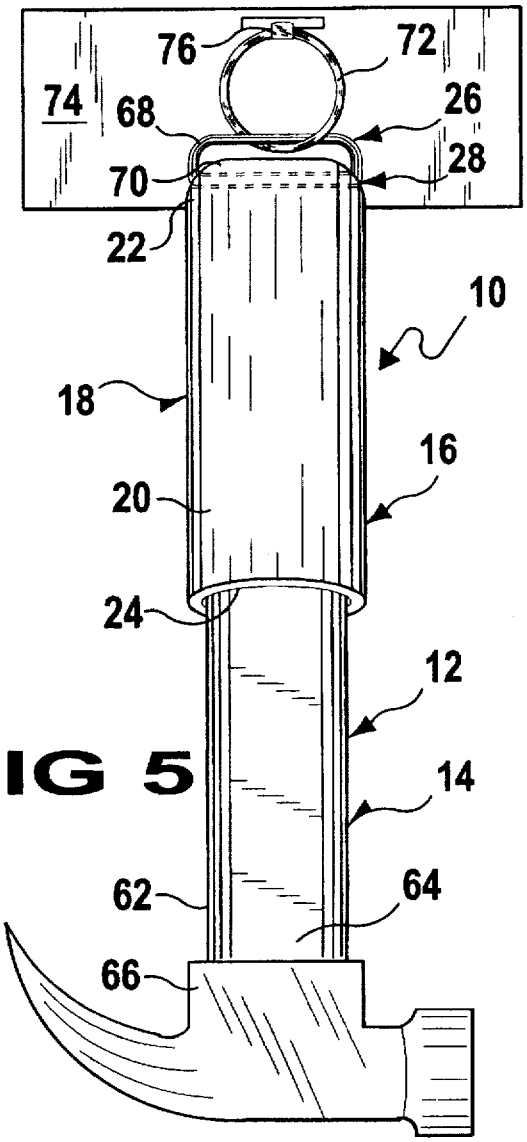
FIG. 5 is a perspective view of the third embodiment engaged with the hammer which is suspended from a mounting plate on a wall.

The article 12 shown in FIGS. 3 and 5, is a hammer 62 having a handle 64 and a head 66. The covering structure 16 engages the handle 64 of the hammer 62. The continuous curved piece 26 is a D-shaped loop 68.

The retaining facility 28 is a hollow member 70, integral with and projecting from the closed end 22 of the covering structure 16. The hollow member 70 will retain the D-shaped loop 68 thereto.

A ring 72 engages with the D-shaped loop 68. A mounting plate 74, shown in FIG. 5, can be affixed by adhesive to a vertical flat surface (not shown). A fastener 76 is for securing the ring 72 to the mounting plate 74, so that the head 66 of the hammer 62 can hang down from the mounting plate 74.

OPERATION OF THE INVENTION

To use the article holding device 10, the following steps should be taken:

1. Roll back the housing 20.
2. Place the elongated portion 14 of the article 12 against the housing 20.
3. Roll the housing 20 over the elongated portion 14 of the article 12.
4. Put the keys 28 onto the key ring 36, as shown in FIGS. 1 and 4.
5. Affix the mounting plate 54 onto the writing surface 56, as shown in FIG. 6.

6. Grasp the barrel 44 by the hand 58.
7. Write with the writing tip 46 on a piece of paper 60 that is on the writing surface 56.
8. Attach the mounting plate 74 onto the vertical flat surface, as shown in FIG. 5.
9. Secure the ring 72 on the mounting plate 74 to the D-shaped loop 68, so that the hammer 62 can hang down therefrom when not in use.

LIST OF REFERENCE NUMBERS

10 article holding device
12 article of 10
14 elongated portion of 12
16 covering structure of 10
18 flexible form fitting sheath for 16
20 housing of 16
22 closed end of 20
24 open end of 20
26 continuous curved piece
28 retaining facility on 22
30 cigarette lighter for 12
32 body of 30
34 top sparking mechanism with flame source of 30
36 key ring for 26
38 key on 36
40 lug for 28
42 pen for 12
44 barrel of 42
46 writing tip of 42
48 ring for 26
50 lug for 28
52 lanyard connected to 50 and 54
54 mounting plate affixed to 56
56 writing surface
58 hand of person
60 piece of paper
62 hammer for 12
64 handle of 62
66 head of 62
68 D-shaped loop for 26
70 hollow member for 28
72 ring
74 mounting plate
76 fastener between 72 and 74

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An article holding device comprising:

a) an article having flat sides with a functional portion at one end and a smooth elongated portion terminating at a second end; and b) means for covering said elongated portion of said article to help prevent loss of said article leaving the functional portion exposed for use comprising a cylindrical flexible form fitting sheath having an opening at one end and closed at the other end, said sheath being capable of being rolled back from the open end and fitting snugly over said elongated portion from the second end of said article so as to conform to the flat sides of said article; and c) lug means integrally formed with the closed end of said sheath in which the closed end is narrowed down, said lug means supporting a key ring at the narrow portion thereof.

* * * * *